United States Patent [19]

Huang

[11] Patent Number: 4,825,549

[45] Date of Patent: May 2, 1989

[54] CARTON SIZE MODIFIER

[75] Inventor: Harrison Huang, Shenkang, Taiwan

[73] Assignee: Glory Formosa Co., Ltd., Taiwan

[21] Appl. No.: 184,943

[22] Filed: Apr. 22, 1988

[51] Int. Cl.[4] ..... B26F 1/32; B26D 1/14

[52] U.S. Cl. ..... 30/293; 30/2; 30/365; 493/57; 493/63; 493/468

[58] Field of Search ..... 493/57, 63, 69, 70, 493/363, 468, 471; 30/2, 286, 292, 293, 365; 403/104, 297, 374

[56] References Cited

U.S. PATENT DOCUMENTS

| | | | |
|---|---|---|---|
| 226,622 | 4/1880 | Moody | 30/365 |
| 2,695,447 | 11/1954 | Maynard | 30/2 |
| 3,191,295 | 6/1965 | Falk | 30/2 |
| 3,304,613 | 2/1967 | Shawhan | 30/2 |

FOREIGN PATENT DOCUMENTS

| | | | |
|---|---|---|---|
| 1680568 | 9/1971 | Fed. Rep. of Germany | 403/374 |

*Primary Examiner*—Frederick R. Schmidt
*Assistant Examiner*—Jack W. Lavinder
*Attorney, Agent, or Firm*—Brumbaugh, Graves, Donohue & Raymond

[57] ABSTRACT

A carton size modifier comprising a tube, a supporting clamp installed on the tube and the structure for forming the hole line at the bottom end of the tube. The hole line forming structure comprised a rotating gear disk unit with a protection cover at its perimeter. The rotating gear disk unit is installed on the pipe seat having a handle. The top face of the pipe seat is cut at an angle to match with a pressing post having a complimentary angle at its lower end. One bolt threads the rotating gear disk unit, the pipe seat and pressing post, with its end fastened by a nut to avoid the fall-off of the pressing post. By puting the pressing post and the top end of the pipe seat into the tube. Then turning the bolt, the pressing post is pulled to make its outer wall supporting against the inner wall of the tube, thus its combination being completed.

2 Claims, 4 Drawing Sheets

CARTON SIZE MODIFIER

BACKGROUND OF THE INVENTION

This invention relates to the field of carton size modifier particularly suited for changing the size of any carton by means of simple process.

As everybody knows, the ordinary carton has its fixed size. What it is used for the carriage of the goods, it really causes some troubles to the user about its limitation. The common thing is that the size of the carton is larger than that of goods which we want to move. In order to solve that problem, some people, when they could not find a suitable one, always put the waste paper, sponge debris.. etc. inside the carton for protection of the goods from any collision under shipment. But if the difference in sizes between the carton and the goods is too larger or under the condition that there is no need to have the buffer of the other materials to protect the goods, the stuffing of waste paper or sponge debris . . . between the carton board and the articles would not make sense but only incerease the weight in transportation and the waste of money in payment of the freight. The other method employed by the people is to modify the size of the carton. But till now, in order to change the size of the carton, people usually cut off the excessive paper boards with scissors. Then they would unnaturally fold the outer boards of the carton with their external force in order to make a carton box of new size. But when they fold the paper boards, there is not any folding line to follow. So people always can not make the perfect folding of corner lines into a nice looking carton. Therefore, the modification work for the size of carton causes much trouble.

SUMMARY OF THE INVENTION

In view of the above mentioned trouble faced by the users as they found that the size of the carton did not meet their actual need, it is an object of this invention to provide a carton size modifier, by which the people can easily modify the size of the carton approaching to the size of the goods which people want to transport. Besides, the boards of the carton can be easily folded and formed the cartons with various sizes & shapes without any difficulty, thus, save the time for the modification of the carton size.

It is a further object to provide a carton size modifier, by using it, people will not need to stuff the waste paper or sponge debris . . . etc. into the carton, and it can make the size of carton fitted to the size of goods to be loaded in the carton. The user then will save the cost and freight caused by the oversize of carton.

Another object of the present invention is to provide a carton size modifier which can make the size of the carton in agreement-with the volume of articles to be loaded in the carton. Inside carton, only a small quantity of gaskets are necessary to add inside the carton to maintain the stability of the goods in transit, so that they will not overturn in mess during the shipment. To a company, such practice can avoid the complaints usually lodged by clients and the goodwill of it can thus be maintained.

A more complete understanding of these and other features and advantages of the present invention will become apparent from a careful consideration of the following detailed description of certain embodiments illustrated in the accompanying drawings.

DETAILED DESCRIPTION OF THE INVENTION

Figure 1:
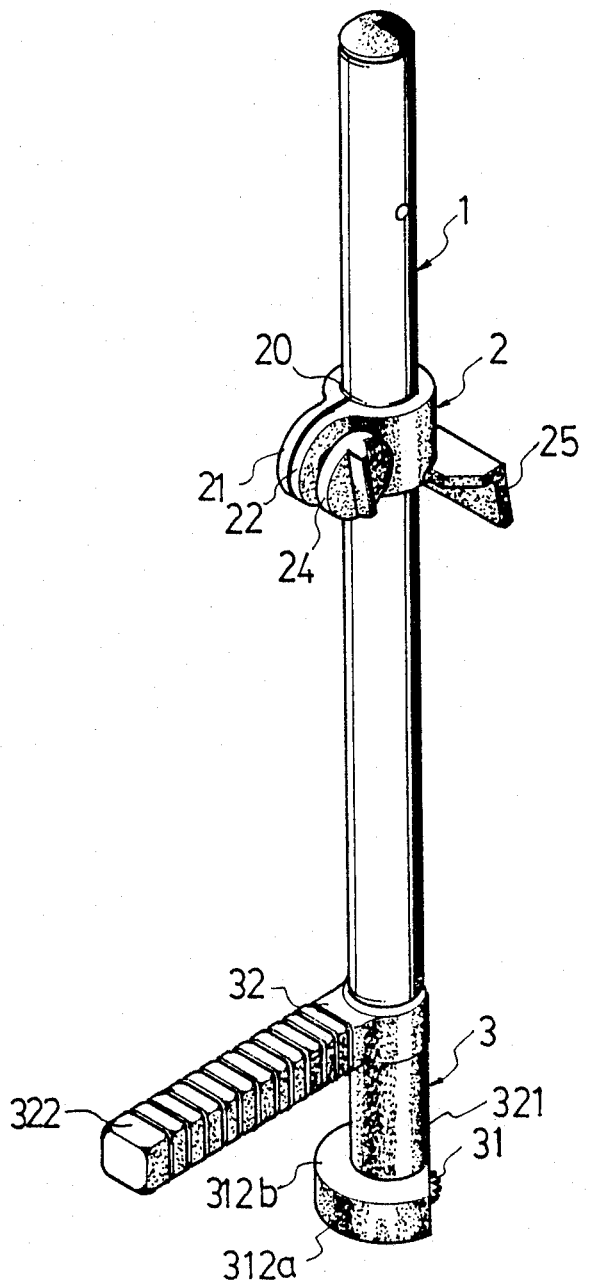
FIG. 1 is a perspective view showing a fully assembled embodiment of the invention.
Figure 2:
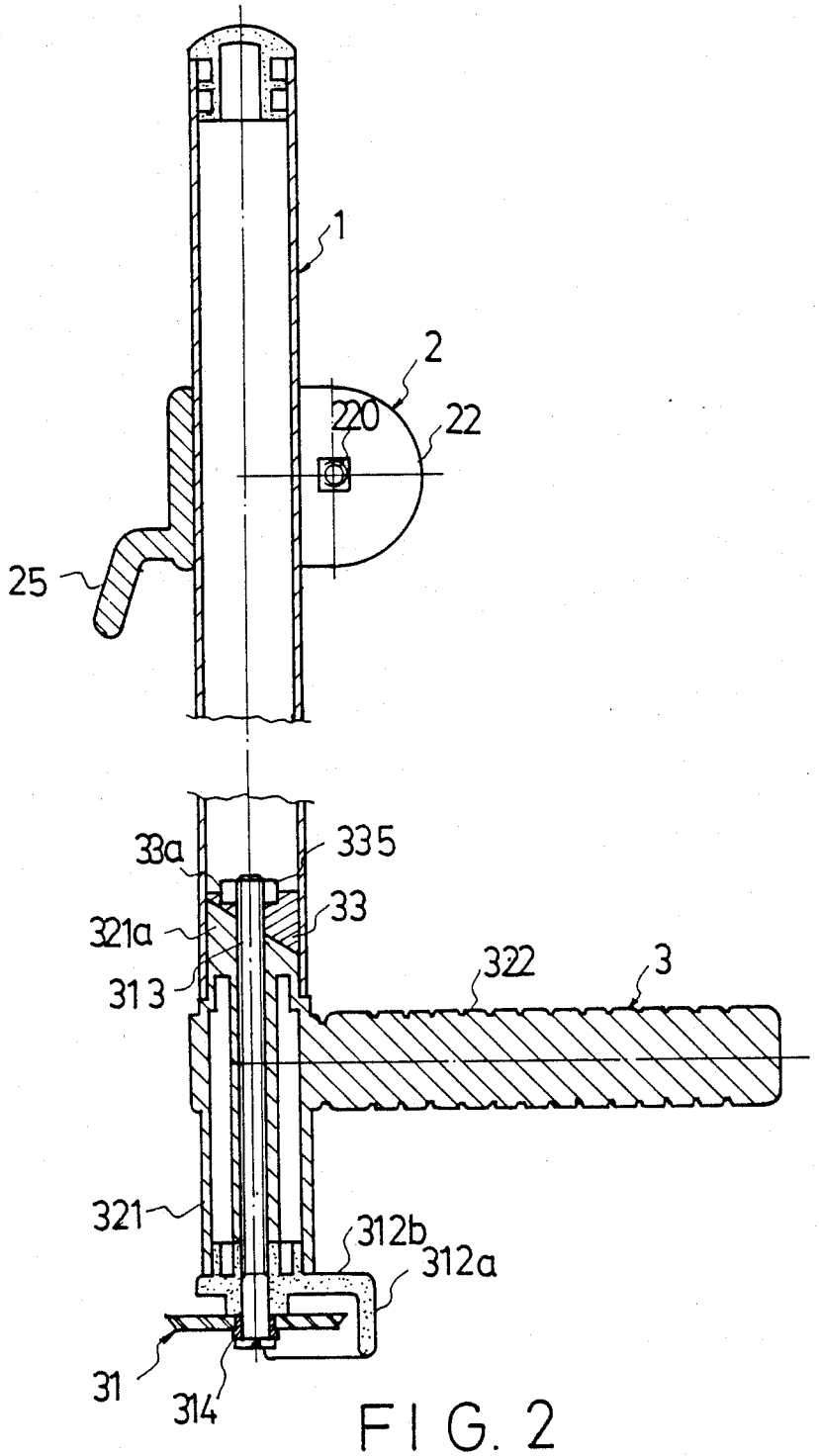
FIG. 2 is a side elevation cross-sectional veiw of the assembled embodiment of the invention.
Figure 3:
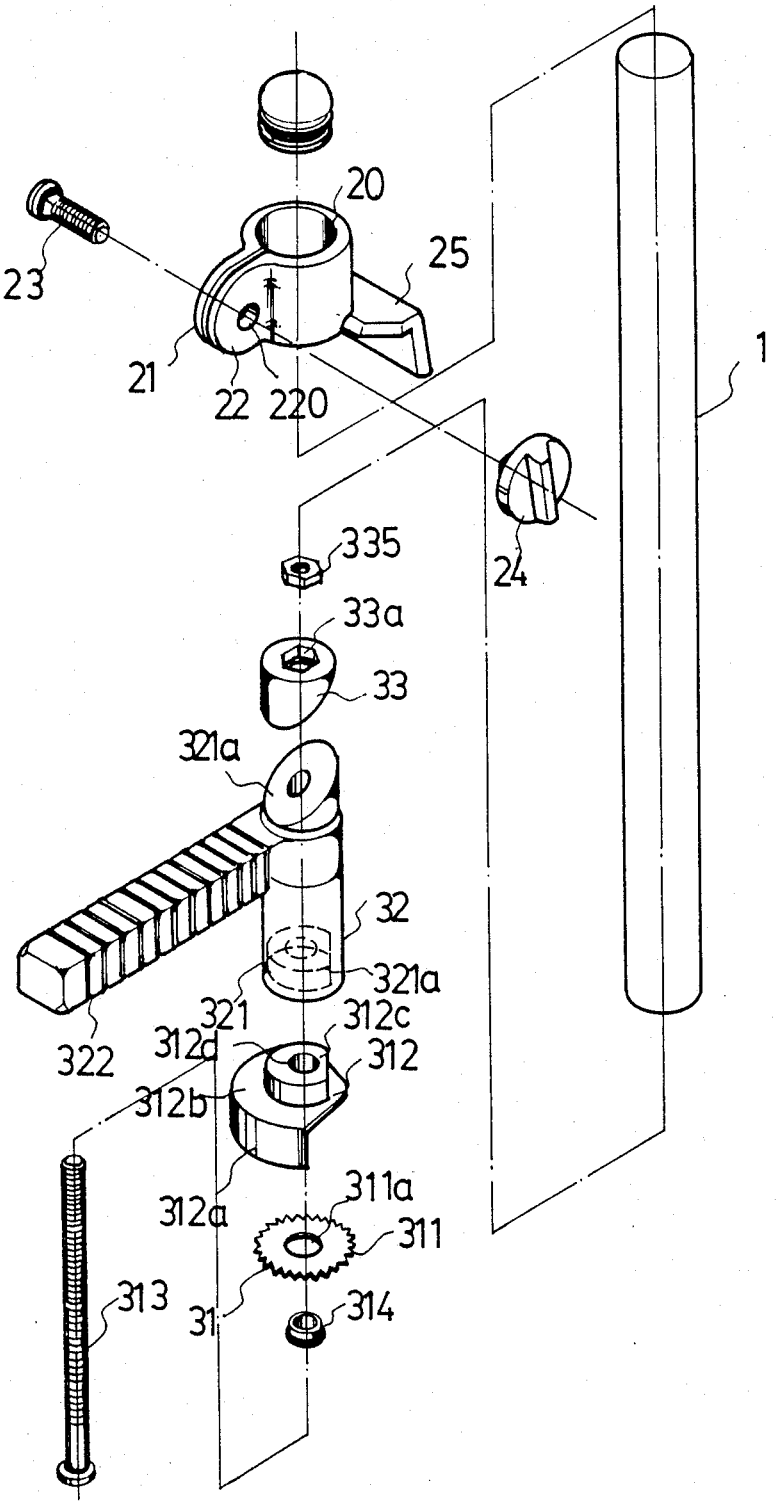
FIG. 3 is a exploded perspective view showing the components of the invention.

Referring to FIGS. 1, 2 and 3, there is shown a carton size modifier comprising a tube 1, a supporting clamp 2 on the tube 1 and the hole line forming structure 3 on the bottom end of the tube, wherein, the tube 1 is a long, hollow tubular body. The supporting clamp 2 has a thimble 20 which can encase the tube 1. Two sides of the opening of the thimble 20 extend a board 21, 22 respectively. On the board 21 & 22, there are holes 210, 220 respectively. A bolt 23 screwed into perforated holes 210, 220 from the outside of the board 21/22, and protrudes out of the outer side of the other board 22/21. Then turning the press button 24 to encase the protruding end of the bolt 23, will cause a tight pressure against the baord 22 or 21, and the press button 24 will pull the bolt to make the two boards 21, 22 come closer to each other. The thimble 20 clamps the tube 1 very tightly. If the press button 24 is turned in the reverse direction, it can release the boards 21, 22 and the thimble 20 will not clamp the tube body 1 tightly and the entire supporting clamp 2 can be moved freely. At the bottom of the thimble 20 of the supporting clamp 2 there is a hooking plate 25 extends a short distance in horizontal direction firstly and then extends a small distance downward, whereby to hook up the upper edge of the carton.

As shown in FIGS. 1, 2, and 3, the hole line forming structure at the bottom end of the tube 1 comprising a rotating gear disk unit 31, a pipe seat 32 with a handle and a pressing post 33, wherein, the rotating gear disk unit 31 has a rotating gear disk 311 with an axial hole **311*a* at its center to let the rotating gear disk 311 encase over an axis tube 314. The semi-circle perimeter of the gear disk is installed with a protection cover 312 made up of a fan board 312*b* and curve board 312*a*. At the top face of the fan board 312*b*, there is a short non-rounded column 312*c*. The short column 312*c'* and the fan board 312*a* have the communicable perforated hole 312*d*. The perforated hole 312*d* and the axial hole 311*a* at the middle of the rotating gear disk 311 are opposite each other to let a stud bolt 313 can be inserted in. The pipe seat 32 is made up of a straight pipe 321 and a handle 322 extends horizontally from the side wall of the straight pipe 321. The bottom part of the straight pipe 321 forms a hole 321 similar to the shape of short column 312*c* at top face of the protection cover 312 of the above rotating gear disk unit 31. The top face 321*a* of the straight pipe 321 is cut at an angle. The pressing post 33 is then a post having a complimentary angle at its lower end to match with the top face 321*a* of the straight pipe 321. At the middle of the top face of the pressing post 33, there is also a concave 33*a*** to contain a nut.

In combination of the hole line forming structure 3, the pressing post 33 is put onto the top face of the pipe seat 32, and then put the rotating gear disk unit 31 to be loaded into the bottom end of the straight pipe 321, to make the stud bolt 313 pass through the axial pipe 314 of the rotating gear disk unit 31, protection cover 312, straight pipe 321 and pressing post 33. Then turns the stud bolt 313 protruding out of the pressing post 33 and the nut 335 tightly, thus completing the combination of the hole line forming structure 3.

By puting the pressing post 33 and the top end of the pipe seat 32 into the lower end of the tube 1. Then turns the stud bolt 313, and the stud bolt 313 again drives the pressing post 33 to move downward. Then the top face 321*a* of the pipe seat 32 and the pressing post 33 are distorted. The pipe face of the pressing post 3 then presses the inner wall of the tube 1 so that the hole line forming structure 3 is secured at the lower end of the tube body 1 to complete the combination of this invention.

Figure 4:
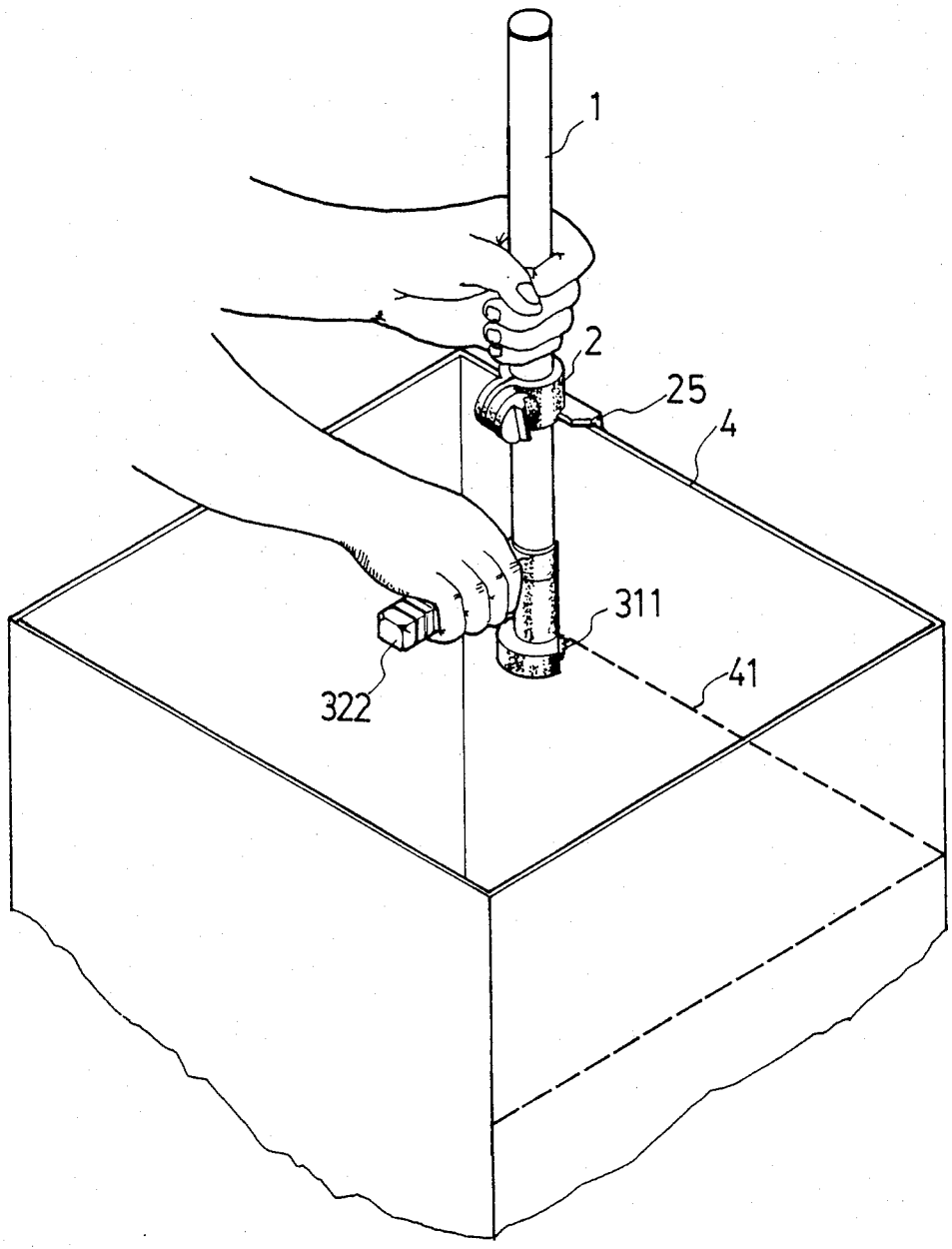
FIG. 4 shows the common method of use on the usage of the present invention.

When the carton size modifier of the present invention is in use as shown in FIG. 4, the position of the supporting clamp 2 on the tube is adjusted firstly to make the hooking plate 25 of the supporting clamp 2 stop on the upper edge of the carton 4. Hold the handle 322 to let the gear disk 311 rotate on the inside wall of the carton to form a hole line 41. When the excessive paper boards are cut off with scissors, it can be very easy for the user to bend the board body of the carton 4 along the hole line 41 to form the cover board, so that, the purpose to modify the size of carton can be easily achieved.

Although the present invention has been described with a certain degree of particularity, it is understood that the present disclosure has been made by way of example and that changes in details of structure may be made without depart from the spirit thereof.

I claim:

1. A carton size modifier comprising:

a long hollow tube;

a supporting clamp installed on said long hollow tube and comprising a hooking plate with a horizontal member and a vertical member for grasping a carton top, and a thimble for affixing said supporting clamp to said long hollow tube at a plurality of positions on said long hollow tube;

a hole line forming structure fixed partially inside and partially below said long hollow tube for having a rotating gear disk unit, a pipe seat with a handle, and a pressing post all joined together by a stud bolt and nut; said rotating gear disk unit having a rotating gear disk disposed between an axial pipe and a protection cover, said protection cover having a semi-circular curve board for encasing half of said rotating gear disk's perimeter and having at said protection cover's top a short non-rounded column that fits into a complimentary shaped cavity at said pipe seat's bottom for fixed positioning said protection cover to said pipe seat, said pipe seat comprises a straight pipe with a sloped top face, and a handle extending radially outward from said straight pipe, said pressing post having a sloped lower end that meshes with said sloped top face such that when said stud bolt is tightened, said pressing post distorts from said sloped top face and presses against said long hollow tube.

2. A carton size modifier according to claim 3 wherein said thimble of said supporting clamp is circular in shape but has a pair of ends adjacent to an opening portion of said thimble, each of said ends has a board with a hole aligned for extending a bolt through both holes, said bolt having a protruding end that screws into a press button for tightening said thimble round said long hollow tube.

* * * * *